US006050408A

United States Patent [19]

Testa

[11] Patent Number: 6,050,408

[45] Date of Patent: Apr. 18, 2000

[54] PAINT BRUSH STORAGE DEVICE

[76] Inventor: Serge Testa, 1 Seawall Dr., Berkeley, Calif. 94710

[21] Appl. No.: 09/139,053

[22] Filed: Aug. 24, 1998

[51] Int. Cl.[7] ..... B65D 81/24; A47B 81/00

[52] U.S. Cl. ..... 206/361; 206/15.2; 206/209; 206/806; 211/65; 248/110; 248/346.04

[58] Field of Search ..... 206/361, 15.2, 206/15.3, 209, 806; 211/65, 66; 248/110, 346.04, 346.06

[56] References Cited

U.S. PATENT DOCUMENTS

| | | | |
|---|---|---|---|
| 1,717,357 | 6/1929 | Dahlstrom | 206/361 |
| 2,141,531 | 12/1938 | Graham | 206/15.2 |
| 2,273,959 | 2/1942 | Holzer | 206/209 |
| 2,929,601 | 3/1960 | Anderson | 248/346.04 |
| 3,918,582 | 11/1975 | Wallace | 206/209 X |
| 4,627,125 | 12/1986 | Gruns | 211/66 X |
| 4,751,762 | 6/1988 | Meimetas | 206/361 X |
| 4,771,501 | 9/1988 | Leiter | 206/361 X |
| 4,865,188 | 9/1989 | Custeau | 206/209 |
| 5,540,363 | 7/1996 | Wilson | 206/361 X |
| 5,829,603 | 11/1998 | Martineau | 211/66 |

*Primary Examiner*—Bryon P. Gehman

[57] ABSTRACT

A paint brush storage device comprising a vessel whose top portion is circular and whose bottom portion tapers inwardly on two sides to conform to the rectangular cross section of a conventional house painting brush. A removable and replaceable water tight closure secures to the top portion of the vessel by mating male and female threads. An integral hook emanates from the top edge of the closure cap and a gasket is located between the interior of the closure cap and an upper lip of the vessel. A preferred embodiment further comprises a separate base plate having peripheral holding tabs capable of receiving the bottom portion of the paint brush storage vessel in an upright position. A flexible clip is affixed to the outside wall of the vessel so that the storage device may be attached to a belt. A further alternate embodiment includes a base plate integral with the bottom portion of the vessel. A further alternate embodiment includes a pair of opposed protrusions molded into the side walls of the paint storage vessel and a corresponding pair of bumps located in the side walls of a modified paint brush thereby causing the bristles to be fully suspended.

6 Claims, 4 Drawing Sheets

PAINT BRUSH STORAGE DEVICE

BACKGROUND OF THE INVENTION

This invention relates generally to the field of storage devices, and more particularly to a paint brush storage device.

Paint brushes have been used for hundreds of years to apply paint to various substrates. In the case of a typical house paint brush there is a handle portion at the upper end and a bristle portion at the lower end. The bristle portion is generally rectangular in cross section. For example, a brush may be one half of an inch thick and two inches wide with a bristle length of about three inches. The bristle width may vary from one half of one inch to as much as six inches or more, however the bristle thickness varies only from about three eighths of an inch to three quarters of an inch.

There are times, when doing a painting job, that it is necessary to stop painting for a period of time. During these times the paint brush either needs to be completely cleaned of paint or needs to be bathed in a solvent so that the paint doesn't dry and harden in the bristles.

Cleaning the paint brush completely tends to be time consuming and can also be wasteful of water or other solvent cleaning materials. Storing a brush in a solvent solution takes less time. Brushes are typically stored in an open topped container with enough solvent in the container to keep the bristle portion moist.

The problem with this method of storage is that because of the normally rectangular cross section of the bristles and the normally cylindrical shape of the storage container, a relatively large amount of solvent needs to be used to bathe the bristles. The wider the bristle portion, the larger the amount of solvent is needed. This can lead to a waste of solvent. Additionally, the ends of the bristles are usually resting at the bottom of the container and with no side support the bristles. Therefore the bristles may deform and eventually stay that way so that when the user takes the brush out of the solvent the bristle portion is bent to one side or the other making it unsuitable for painting. Also, if a brush or brushes are sitting in an opened top solvent filled container, there is a good chance that the solvent fumes will permeate the nearby environment. Solvents such as turpentine or acetone are known carcinigens and therefore are not healthy to have in the air. Finally, there is a chance, while carrying a brush that is bathing in solvent, for the solvent to slosh and spill therefore causing undo mess and clean up delays.

SUMMARY OF THE INVENTION

The primary object of the invention is to provide a better paint brush storage device that allows the brush portion to be bathed in a relatively small amount of paint thinner or cleaner.

Another object of the invention is to provide a paint brush storage device that cradles the bristles of the brush securely so that they do not deform during storage.

Another object of the invention is to provide a paint brush storage device that has a water tight screw on lid thereby prohibiting the possibility of spillage.

Another object of the invention is to provide a paint brush storage device that can be hung or can be placed in a stand to maintain a vertical orientation. A flexible clip mounted to the side of the container allows it to be carried on a belt.

A further object of the invention is to provide a paint storage device that can be used as a packaging means when selling brushes in retail sales locations.

Other objects and advantages of the present invention will become apparent from the following descriptions, taken in connection with the accompanying drawings, wherein, by way of illustration and example, an embodiment of the present invention is disclosed.

A paint brush storage device comprising: a vessel whose open top portion is circular in shape whose bottom closed portion has tapered sidewalls that taper inwardly at either side to conform to the rectangular cross section of the bristle portion of a conventional house painting brush, a removable and replaceable water tight closure secured to the top portion of the vessel by mating male and female threads, an integral hook emanating from the top edge of the closure cap and a gasket seal between the interior of the closure cap and an upper lip of the vessel. An alternate embodiment includes either a separate or an integral base plate for keeping the paint brush storage device in a vertical position. A second alternate embodiment includes a brush suspension means when coupled with a specially modified paint brush.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
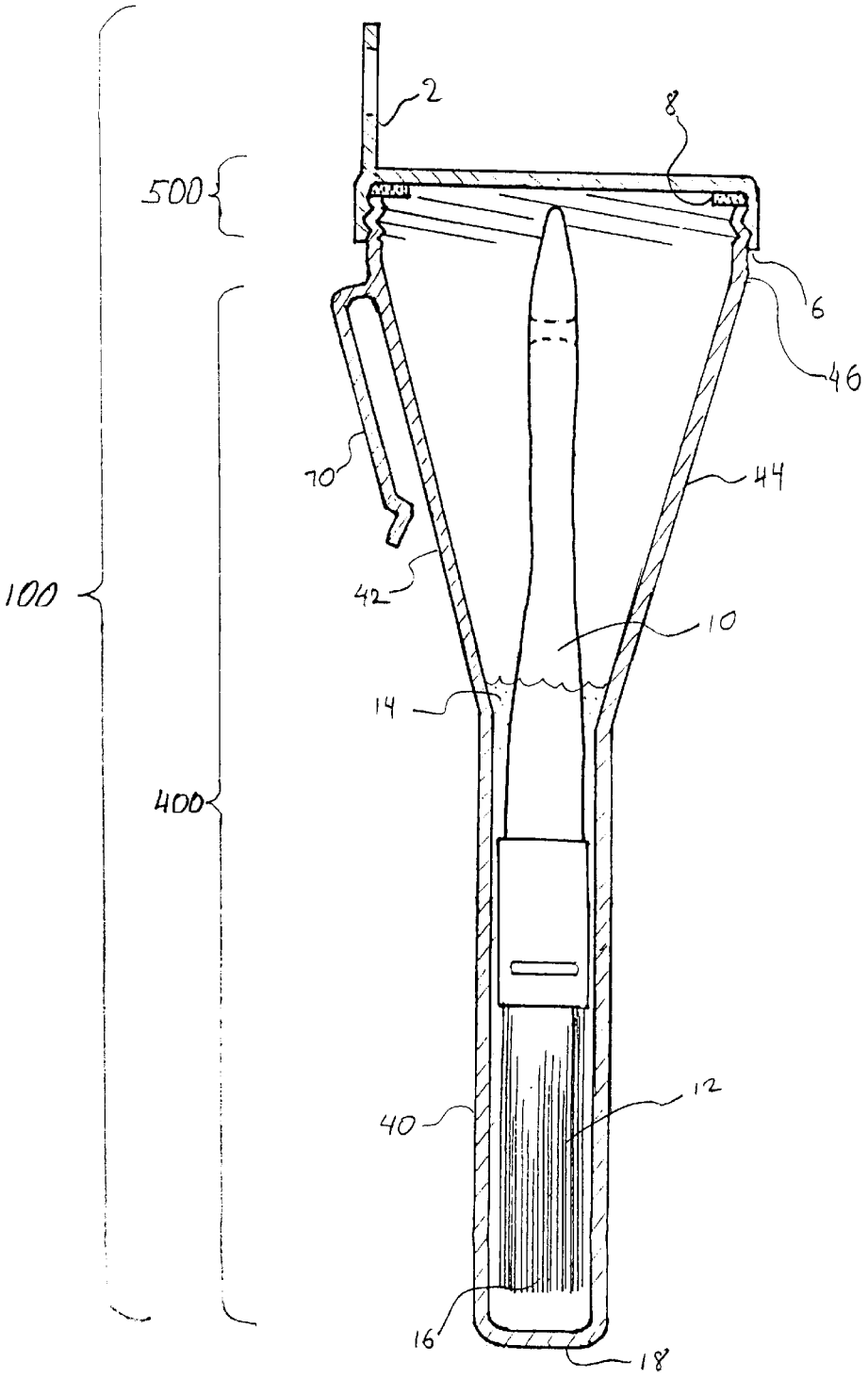
FIG. 1 is a cross section view of the paint brush storage device of the present invention.

Referring now to FIG. 1 we see a cross section of the paint storage device of the present invention 100. Reservoir vessel 400 is tapered inwardly on either side 42,44 going from a circular open top portion at 46 to a rectangular portion at 40. Paint brush bristles 12 are held securely by side walls 40 so that they can not deform while being stored. Solvent 14 fills vessel 400 up to the top of the bristle portion. Because of the close proximity of the vessel wall 40 to the bristle portion 12, the user needs only to put a relatively small amount of solvent in the vessel 400 thereby saving valuable solvent. Cover 500 has an internal threaded portion 6 which mates with a corresponding threaded portion at the top of vessel 400. Gasket 8 is made of a resilient material such as closed cell foam or rubber and acts to ensure that the top closure 500 is leak proof. The vessel portion 400 and closure portion 500 is made of a solvent resistant plastic material such as polymopylene or polyethylyne. The manufacturing technique for the paint storage device 100 can be blow molded or injection molded. Hook 2 which is integral to closure top 500 can be used to hang the entire storage device 100 in a relatively vertical position. It is intended that there be several sizes of the storage device 100. For example one for brushes with bristles up to two inches in width, one for bristles up to four inches in width and one for bristles up to six inches in width. These different configurations would require corresponding diameters of closures 500, however the overall configuration of the device 100 is similar. Clip 70 allows a person to fasten the storage device 100 to his or her belt.

Figure 2:
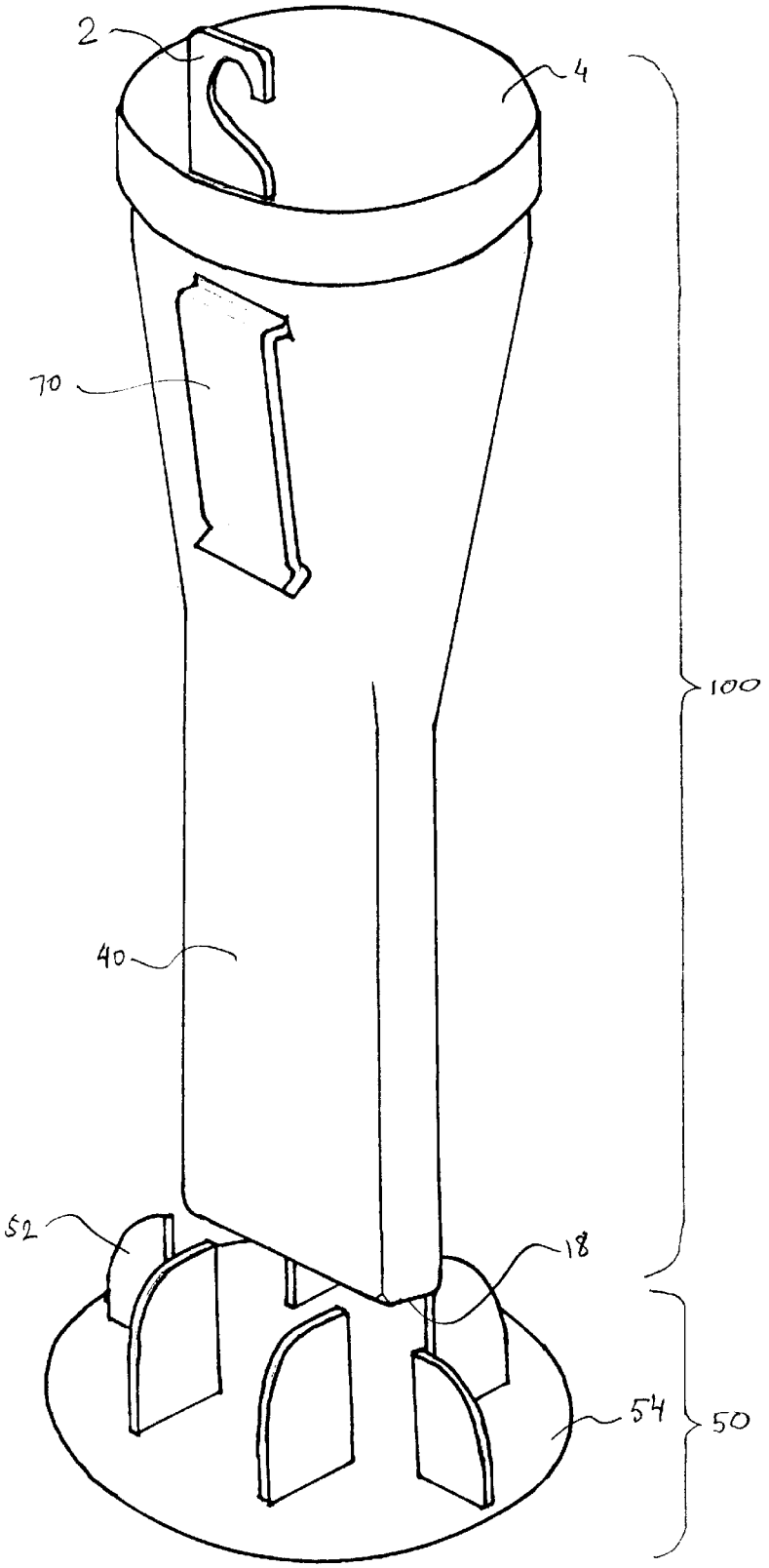
FIG. 2 is a perspective view of the paint brush storage device of the present invention along with a separate bottom holding retainer.

FIG. 2 shows a perspective view of the entire storage device 100 and how it can engage with a retaining plate 50 thereby holding it in the desired vertical position. The retaining plate 50 has a horizontal plate 54 and a plurality of vertical holding tabs 52. The bottom portion 18 of the storage device 100 slips into and out of the holding tabs 52 maintaining a vertical position.

Figure 3:
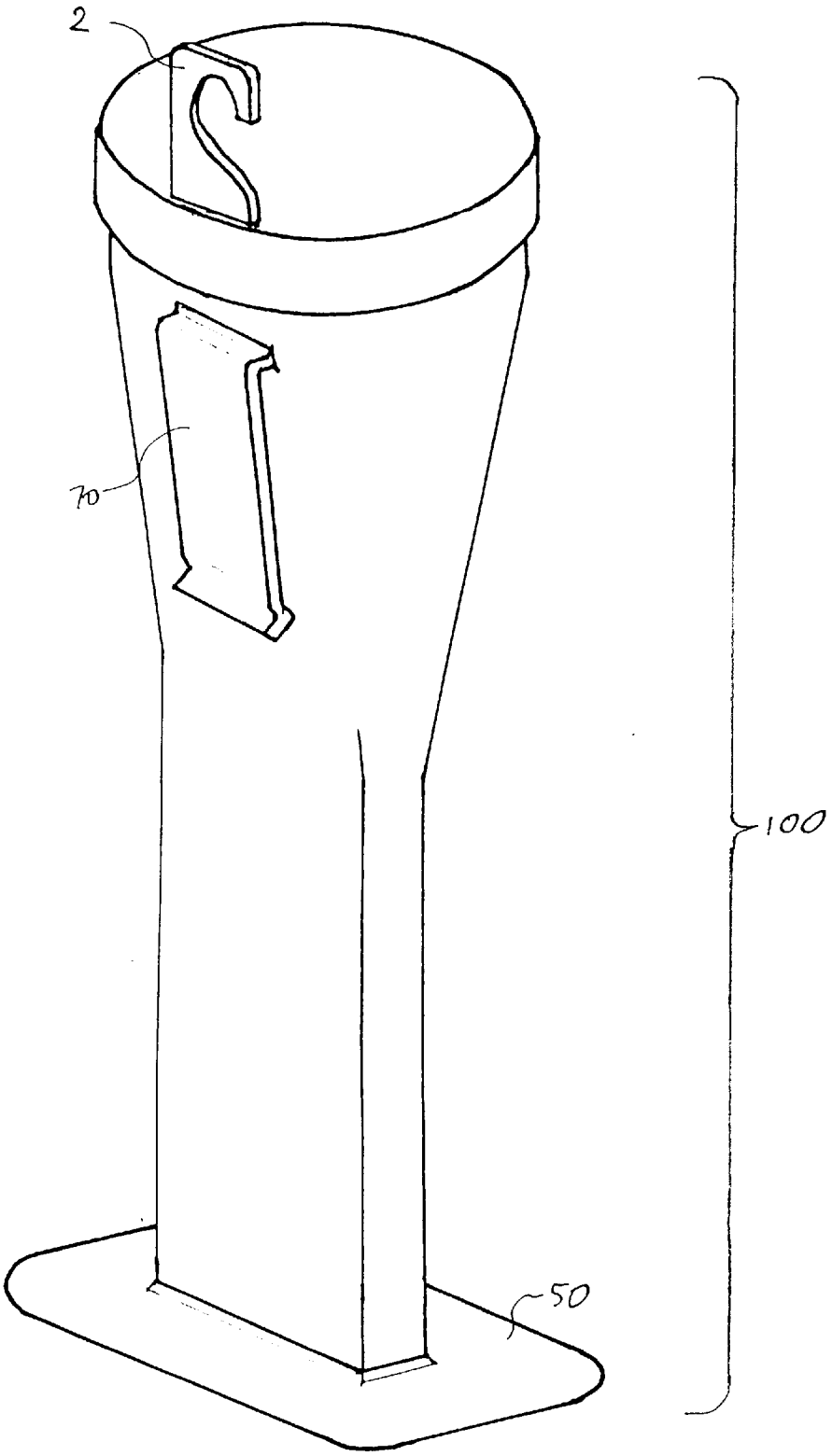
FIG. 3 is a perspective view of an alternate paint brush storage device of the present invention with an integral base plate.

FIG. 3 shows a perspective view of an alternate embodiment where the storage device 100 terminates at the bottom with an integral horizontal base plate 60. This embodiment may be more suitable for manufacture by injection molding and not blow molding.

Figure 4:
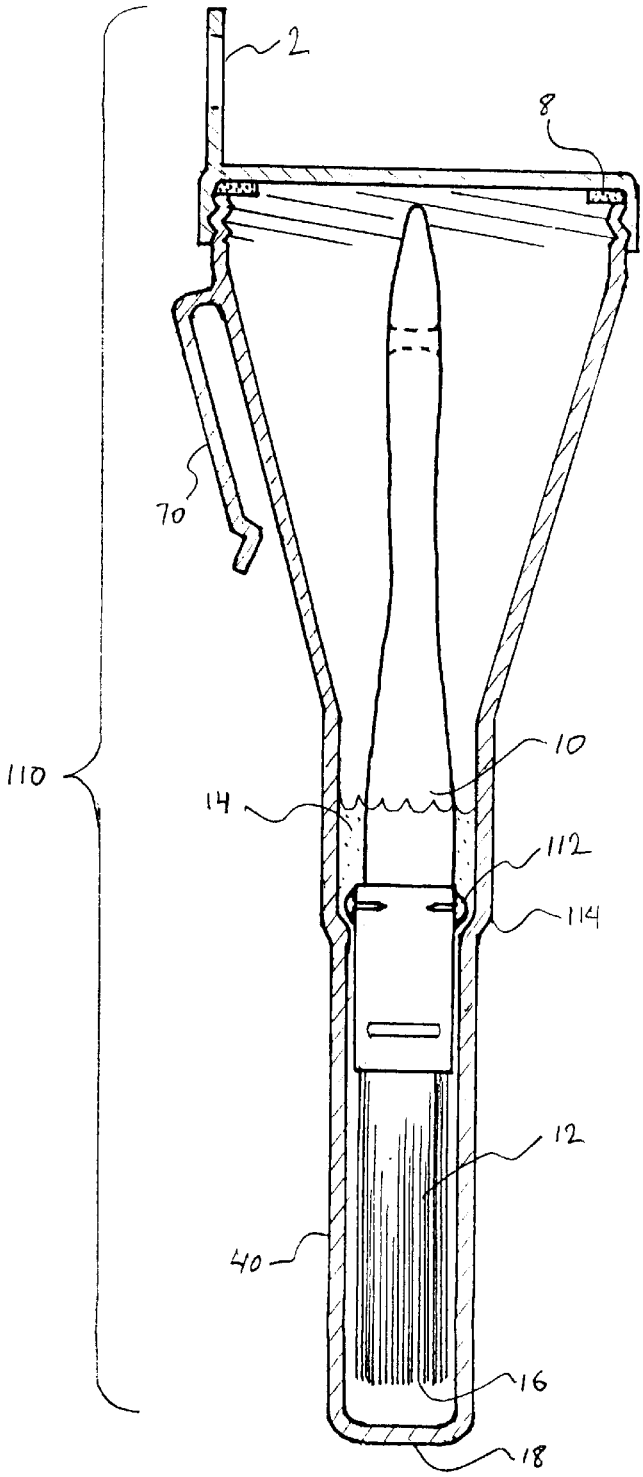
FIG. 4 shows a cross section view of an alternate paint brush storage device with a bristle suspension means.

FIG. 4 is a cross section of an alternate embodiment of a paint brush storage device 110 where there is a secondary protrusion 114 on either side of vertical walls 40 which corresponds to bumps 112 on paint brush handle 10. This configuration causes bristles 12 to be suspended so that the bristle tips 16 do not touch the bottom of the vessel at 18. This configuration further insures that the bristles do not deform while in storage, however, it requires that paint brush manufacturers include an opposing set of bumps 112 onto their paint brushes or that a person modify an existing paint brush by installing bumps such as nail heads or stick on bumps to the paint brush handle 10.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A paint brush storage device comprising:

a vessel having an outside wall whose open top portion is circular in shape and whose bottom closed portion has tapered side walls that taper inwardly at either side to substantially conform to the generally rectangular cross section of the bristle portion of a conventional house painting brush; a removable and replaceable watertight closure cap secured to the top portion of said vessel by mating male and female screw threads on the closure cap and open top portion of said vessel; and a gasket seal between the interior of said closure cap and an upper lip of said vessel.

2. A paint brush storage device as claimed in claim 1 further comprising a separate base plate having a peripheral holding means capable of receiving said bottom portion of said vessel in an upright position.

3. A paint brush storage device as claimed in claim 1 wherein a horizontally disposed flat plate defines the bottom surface of said vessel.

4. A paint brush storage device as claimed in claim 1 wherein said tapered side walls include a pair of opposing protrusions which would correspond to a pair of opposed bumps located in the side walls of the handle of a painting brush.

5. A paint brush storage device as claimed in claim 1 wherein said vessel has affixed to its outside wall a resilient clip capable of fastening said paint brush storage device to a belt.

6. A paint brush storage device as claimed in claim 1 further comprising an integral hook emanating from the top edge of said closure cap.

* * * * *